US010295288B2

(12) United States Patent
Maga

(10) Patent No.: US 10,295,288 B2
(45) Date of Patent: May 21, 2019

(54) SIDE-LOADING FIXED MAGAZINE WITH RETRACTABLE FOLLOWER AND SLIDING AMMUNITION LOADING SLEEVE

(71) Applicant: David Dallas Maga, Castaic, CA (US)

(72) Inventor: David Dallas Maga, Castaic, CA (US)

( * ) Notice: Subject to any disclaimer, the term of this patent is extended or adjusted under 35 U.S.C. 154(b) by 0 days.

(21) Appl. No.: 15/950,165

(22) Filed: Apr. 10, 2018

(65) Prior Publication Data

US 2018/0292156 A1 Oct. 11, 2018

Related U.S. Application Data

(60) Provisional application No. 62/483,822, filed on Apr. 10, 2017.

(51) Int. Cl.

| | |
|---|---|
| ***F41A 9/65*** | (2006.01) |
| ***F41A 17/38*** | (2006.01) |
| ***F41A 9/67*** | (2006.01) |
| ***F41A 3/66*** | (2006.01) |

(52) U.S. Cl.
CPC ..... *F41A 17/38* (2013.01); *F41A 3/66* (2013.01); *F41A 9/67* (2013.01)

(58) Field of Classification Search
CPC ..... F41A 9/65; F41A 9/67; F41A 9/83; F41A 9/71; F41A 17/38
USPC ..... 42/50, 49.01, 18, 87
See application file for complete search history.

(56) References Cited

U.S. PATENT DOCUMENTS 1,797,951 A * 3/1931 Gaidos ..... F41A 9/67 42/50
2,477,936 A * 8/1949 Molins ..... F41A 9/76 89/33.01
2,585,738 A * 2/1952 Chapin ..... F41A 9/55 42/18

(Continued)

FOREIGN PATENT DOCUMENTS

WO 2009032742 A1 3/2009

OTHER PUBLICATIONS

Website Link: https://www.armaglock.com/ Downloaded Jan. 12, 2017 AR-15 Fixed Magazine.

(Continued)

*Primary Examiner* — Michael D David
(74) *Attorney, Agent, or Firm* — Russ Weinzimmer & Associates, P.C.

(57) ABSTRACT

An affixable magazine complying with new firearms laws that enables citizens to legally own and effectively operate a firearm, such as an AR-15. The affixable magazine facilitates easy loading of ammunition through a sliding sleeve without removing the magazine from the firearm, disassembling the action, or using tools. The affixable magazine includes: a magazine body configured to contain a stack of cartridges, and an attachable blocking tab for blocking removal of the ammunition magazine from the magazine well, the attachable blocking tab being attached after insertion of the ammunition magazine into the magazine well, and before re-engaging the upper receiver with the lower receiver. The affixable magazine also includes a magazine body having an opening, with a sliding sleeve configured to alternately cover or reveal the opening, the sliding sleeve including: at least one groove and at least one groove end catch configured to catch and retract the follower.

18 Claims, 6 Drawing Sheets

(56) References Cited

U.S. PATENT DOCUMENTS

| | | | | | |
|---|---|---|---|---|---|
| 2,908,987 | A * | 10/1959 | Allyn | F41A 9/65 | 124/52 |
| 3,005,279 | A * | 10/1961 | Brewer | F41A 3/22 | 42/18 |
| 4,430,821 | A | 2/1984 | Vincent | | |
| 4,502,237 | A * | 3/1985 | Krogh | F41A 9/70 | 42/50 |
| 4,588,240 | A | 5/1986 | Ruehl et al. | | |
| 4,614,052 | A | 9/1986 | Brown et al. | | |
| 4,688,344 | A | 8/1987 | Kim | | |
| 4,707,941 | A * | 11/1987 | Eastman | F41A 9/68 | 42/49.02 |
| 5,278,690 | A | 1/1994 | Vella-Coleiro | | |
| 5,461,811 | A | 10/1995 | Ciener | | |
| 5,697,179 | A * | 12/1997 | Vanmoor | F41A 9/65 | 42/50 |
| 5,806,224 | A | 9/1998 | Hager | | |
| 6,212,815 | B1 * | 4/2001 | Fitzpatrick | F41A 9/65 | 224/196 |
| 6,311,603 | B1 | 11/2001 | Dunlap | | |
| 6,481,136 | B1 | 11/2002 | Fitzpartick | | |
| 6,739,082 | B2 | 5/2004 | Christensen | | |
| 6,807,764 | B1 * | 10/2004 | Phillips | F41A 9/83 | 42/87 |
| 7,162,824 | B1 | 1/2007 | McCormick | | |
| 7,200,964 | B2 * | 4/2007 | Gates | F41A 9/67 | 42/49.01 |
| 7,444,775 | B1 | 11/2008 | Schuetz | | |
| 7,497,044 | B2 | 3/2009 | Cammenga et al. | | |
| 7,941,955 | B2 | 5/2011 | Stone | | |
| 8,316,567 | B2 * | 11/2012 | Douglas | F41A 9/67 | 42/50 |
| 8,418,390 | B1 | 4/2013 | Wright | | |
| 8,720,095 | B2 * | 5/2014 | Wright | F41A 9/65 | 42/50 |
| 8,756,845 | B2 | 6/2014 | Harris et al. | | |
| 9,103,614 | B2 * | 8/2015 | Froehle | F41A 9/67 | |
| 9,121,652 | B1 | 9/2015 | Mangiameli | | |
| 9,303,934 | B1 * | 4/2016 | Kazsuk | F41A 9/83 | |
| 9,341,421 | B2 | 5/2016 | Findlay | | |
| 9,395,130 | B2 | 7/2016 | Jacobson | | |
| 9,482,478 | B2 | 11/2016 | Newman | | |
| 9,683,797 | B2 * | 6/2017 | Boyarkin | F41A 9/67 | |
| 2011/0173858 | A1 * | 7/2011 | Troy | F41A 9/65 | 42/50 |
| 2014/0223790 | A1 | 8/2014 | Wilson | | |
| 2015/0096214 | A1 * | 4/2015 | Jones, III | F41A 9/71 | 42/49.01 |
| 2015/0276339 | A1 * | 10/2015 | Shreve | F41A 11/00 | 42/50 |

OTHER PUBLICATIONS

Website Link: http://www.gunauction.com/buy/10420062 Downloaded Jan. 12, 2017 Semi-Auto Rifle Fixed Magazine.

Website Link: https://www.youtube.com/watch?v=F0nnd0Parco Downloaded Jan. 2, 2017 ARMagLock Install By installing an ARMagLock you no longer own a “detachable” magazine firearm. ARMagLock renders your MIL-SPEC AR-15 (and AR-10) a fixed magazine firearm while installed.

* cited by examiner

SIDE-LOADING FIXED MAGAZINE WITH RETRACTABLE FOLLOWER AND SLIDING AMMUNITION LOADING SLEEVE

CROSS-REFERENCE TO RELATED APPLICATIONS

This application claims priority to Provisional Application No. 62/483,822, filed Apr. 10, 2017, entitled "Fixed Firearms Magazine Loadable Via a Downward-Sliding Sleeve", the entire contents of which is herein incorporated by reference.

FIELD OF INVENTION

This invention relates generally to magazines for use with firearms, and more particularly to magazines that are affixable to a firearm such that the magazine is not removable from the firearm.

BACKGROUND OF THE INVENTION

Firearm laws have been passed in states such as California and New York which require that certain rifles and pistols must be modified to remain legal. In particular, semi-automatic firearms, such as AR-15 rifles and pistols, are being subject to more restrictions, including a prohibition against "detachable magazines". California law, for example, requires a "fixed magazine", where "fixed magazine" means an ammunition feeding device contained in, or permanently attached to, a firearm in such a manner that the device cannot be removed without disassembly of the firearm action.

Standard semi-automatic firearms have typically been made and sold for use with detachable magazines. In response to the restrictions of the newer firearms laws, semiautomatic firearms are being made and sold with fixed magazines. Further, conversion kits are being sold to convert a firearm with a detachable magazine to a firearm with a fixed magazine.

For example, Hager U.S. Pat. No. 5,806,224 teaches a semi-automatic firearm with a non-removable magazine. Also, Stone U.S. Pat. No. 7,941,955 B2 teaches a pivoting, non-detachable magazine. Further, Harris et al. U.S. Pat. No. 8,756,845 B2 teaches method and device for converting a firearm with detachable magazine to a firearm with a fixed magazine.

SUMMARY OF THE INVENTION

By providing an affixable magazine according to the new firearms laws of many states, citizens of those states will be able to legally own a firearm, such as an AR-15.

The affixable magazine of the invention satisfies the new firearms laws, being loadable in a way that does not violate the law.

The affixable magazine of the invention is a plastic or metal magazine for centerfire rifles which can be fixed into position so as to become a non-removable magazine, yet it can open while attached to the rifle for easy loading of cartridges.

The method of attachment of the fixed magazine will vary in accordance with the different makes and models of each rifle. The end result of the fixing of the magazine will be compliance with state or local laws, while also facilitating loading of the magazine in a convenient manner.

The affixable magazine of the invention allows a user to easily load the fixed magazine with ammunition without removing the magazine from the firearm, disassembling the action, or using tools. (If this is not legal in your state, a fixed magazine will be provided that requires a tool to open it to load ammunition, but it will open in the same manner as a fixed magazine that does not require a tool.)

A general aspect of the invention is an affixable ammunition magazine for use with a firearm with an upper receiver and a lower receiver, the lower receiver having a magazine well for receiving the ammunition magazine. The ammunition magazine includes: a magazine body configured to contain a stack of cartridges, the magazine body having a feeding end configured to feed rounds of ammunition to the firearm, the magazine body including a side opening; a movable sleeve configured to surround the magazine body and secure the stack of cartridges, the movable sleeve having at least one sleeve groove along at least one side, the at least one sleeve groove having a groove end catch; a cartridge follower assembly having: a cartridge follower, and a cartridge follower spring configured to be compressed by the cartridge follower when the groove end catch has engaged with and has pulled down the cartridge follower, and the cartridge follower spring is configured to expand when the groove end catch is disengaged from the cartridge follower, thereby allowing the cartridge follower to urge the stack of cartridges towards the feeding end of the ammunition magazine; and an attachable blocking tab configured to be attached to the feeding end of the magazine body, and configured to block removal of the ammunition magazine from the magazine well, the attachable blocking tab being attached to the feeding end of the magazine body after insertion of the ammunition magazine into the magazine well, and before re-engaging the upper receiver with the lower receiver.

In some embodiments, the cartridge follower includes: a cartridge follower top plate configured to push upward on the bottom of the stack of cartridges, at least one carrier, and at least one follower tab configured to slidably engage within the at least one sleeve groove, the at least one follower tab configured to engage with and be pulled downward by the groove end catch when the movable sleeve is in a down position.

In some embodiments, the affixable ammunition magazine further includes: a locking button springedly attached to the magazine body, configured to cooperate with an upper sleeve locking hole to secure the movable sleeve in an open position, and the locking button alternately configured to cooperate with a lower sleeve locking hole to secure the movable sleeve in a closed position.

In some embodiments, the cartridge follower includes at least one spring attachment tab configured to attach to the cartridge follower spring.

In some embodiments, the movable sleeve includes a raised bump grip.

In some embodiments, the magazine body, the movable sleeve, the cartridge follower, and the cartridge follower spring are made from at least one of: metal, nylon, plastic, carbon fiber.

Another general aspect of the invention is an affixable ammunition magazine for use with a firearm with an upper receiver and a lower receiver, the lower receiver having a magazine well for receiving the ammunition magazine. This ammunition magazine includes: a magazine body configured to contain a stack of cartridges, the magazine body having a feeding end configured to feed rounds of ammunition to the firearm, the magazine body including a rear opening; a movable sleeve configured to surround the magazine body and secure the stack of cartridges, the movable sleeve having at least one sleeve groove along at least one side, the at least one sleeve groove having a groove end catch; a cartridge follower assembly having: a cartridge follower, and a cartridge follower spring configured to be compressed by the cartridge follower when the groove end catch has engaged with and has pulled down the cartridge follower, and the cartridge follower spring is configured to expand when the groove end catch is disengaged from the cartridge follower, thereby allowing the cartridge follower to urge the stack of cartridges towards the feeding end of the ammunition magazine; and an attachable blocking tab configured to be attached to the feeding end of the magazine body, and configured to block removal of the ammunition magazine from the magazine well, the attachable blocking tab being attached to the feeding end of the magazine body after insertion of the ammunition magazine into the magazine well, and before re-engaging the upper receiver with the lower receiver.

In some embodiments, the cartridge follower includes: a cartridge follower top plate configured to push upward on the bottom of the stack of cartridges, an at least one carrier, and at least one follower tab configured to slidably engage within the at least one sleeve groove, the at least one follower tab configured to engage with and be pulled downward by the groove end catch when the movable sleeve is in a down position.

In some embodiments, the affixable ammunition magazine further includes: a locking button springedly attached to the magazine body, configured to cooperate with an upper sleeve locking hole to secure the movable sleeve in an open position, and the locking button alternately configured to cooperate with a lower sleeve locking hole to secure the movable sleeve in a closed position.

In some embodiments, the cartridge follower includes at least one spring attachment tab configured to attach to the cartridge follower spring.

In some embodiments, the movable sleeve includes a raised bump grip.

In some embodiments, the magazine body, the movable sleeve, the cartridge follower, and the cartridge follower spring are made from at least one of: metal, nylon, plastic, carbon fiber.

Yet another general aspect of the invention is an affixable ammunition magazine for use with a firearm with an upper receiver and a lower receiver, the lower receiver having a magazine well for receiving the ammunition magazine. This ammunition magazine includes: a magazine body configured to contain a stack of cartridges, the magazine body having a feeding end configured to feed rounds of ammunition to the firearm, the magazine body including a front opening; a movable sleeve configured to surround the magazine body and secure the stack of cartridges, the movable sleeve having at least one sleeve groove along at least one side, the at least one sleeve groove having a groove end catch; a cartridge follower assembly having: a cartridge follower, and a cartridge follower spring configured to be compressed by the cartridge follower when the groove end catch has engaged with and has pulled down the cartridge follower, and the cartridge follower spring is configured to expand when the groove end catch is disengaged from the cartridge follower, thereby allowing the cartridge follower to urge the stack of cartridges towards the feeding end of the ammunition magazine; and an attachable blocking tab configured to be attached to the feeding end of the magazine body, and configured to block removal of the ammunition magazine from the magazine well, the attachable blocking tab being attached to the feeding end of the magazine body after insertion of the ammunition magazine into the magazine well, and before re-engaging the upper receiver with the lower receiver.

In some embodiments, the cartridge follower includes: a cartridge follower top plate configured to push upward on the bottom of the stack of cartridges, an at least one carrier, and at least one follower tab configured to slidably engage within the at least one sleeve groove, the at least one follower tab configured to engage with and be pulled downward by the groove end catch when the movable sleeve is in a down position.

In some embodiments, the affixable ammunition magazine further including: a locking button springedly attached to the magazine body, configured to cooperate with an upper sleeve locking hole to secure the movable sleeve in an open position, and the locking button alternately configured to cooperate with a lower sleeve locking hole to secure the movable sleeve in a closed position.

In some embodiments, the cartridge follower includes at least one spring attachment tab configured to attach to the cartridge follower spring.

In some embodiments, the movable sleeve includes a raised bump grip.

In some embodiments, the magazine body, the movable sleeve, the cartridge follower, and the cartridge follower spring are made from at least one of: metal, nylon, plastic, carbon fiber.

BRIEF DESCRIPTION OF THE DRAWINGS

The invention will be more fully understood from the following detailed description, in conjunction with the following figures, wherein.

DETAILED DESCRIPTION

Figure 1A:
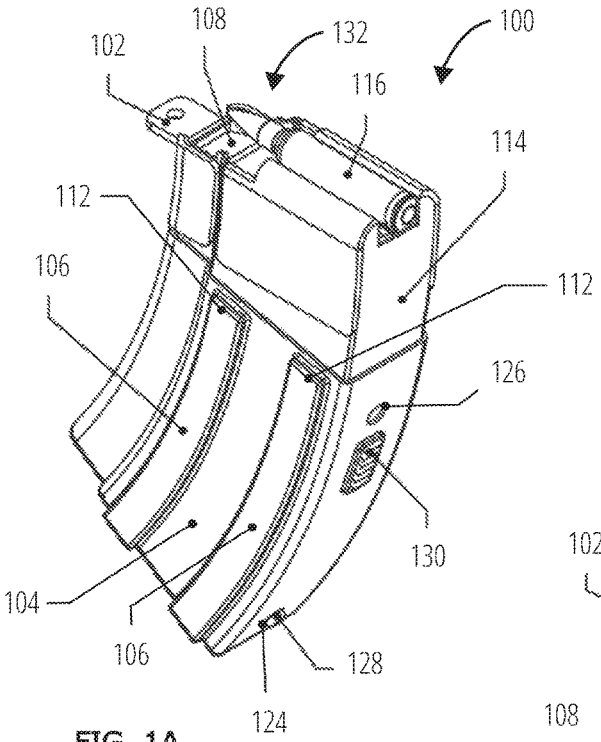
FIG. 1A is a perspective view showing the rear, side, and top views of an embodiment of an ammunition magazine that can be fixed to a firearm, while also facilitating loading of the ammunition magazine via a movable sleeve and a side opening, with the movable sleeve in the upward position, also showing one cartridge within the ammunition magazine.

With reference to FIG. 1A, a perspective view is shown of an ammunition magazine 100 containing a cartridge 116. The ammunition magazine 100 includes an attachable blocking tab 102 which is to be fixedly attached to a firearm lower receiver (not shown) such that the ammunition magazine 100 is prevented from being easily removed from the firearm, i.e., from the bottom of the magazine well. The attachable blocking tab 102 blocks removal of the ammunition magazine 100 from the magazine well (not shown), the attachable blocking tab 102 being attached at a feeding end 132 after insertion of the ammunition magazine 100 into the magazine well (not shown), and before re-engaging the upper receiver (not shown) with the lower receiver (not shown).

Other embodiments of the ammunition magazine 100 may have alternative fixing methods to the attachable blocking tab 102, such as screws or other types of tabs, and all alternative fixing methods will attach the ammunition magazine 100 to the firearm lower receiver (not shown) in accordance with local laws.

In this embodiment, a movable sleeve 104 is configured to be pulled down along a magazine body 114. As the movable sleeve 104 is pulled down, four groove end catches 112 engage four respective follower tabs 204 of a cartridge follower 108 (shown in FIG. 2A), thereby pulling down the cartridge follower 108 (shown in FIG. 1B) and compressing a cartridge follower spring 110 (shown in FIG. 1B). This action opens a space within magazine body 114 so as to provide access through a side opening 120 (shown in FIG. 1B) to a magazine cavity 118 (shown in FIG. 1B) configured to receive the stack of cartridges 116.

Figure 1B:
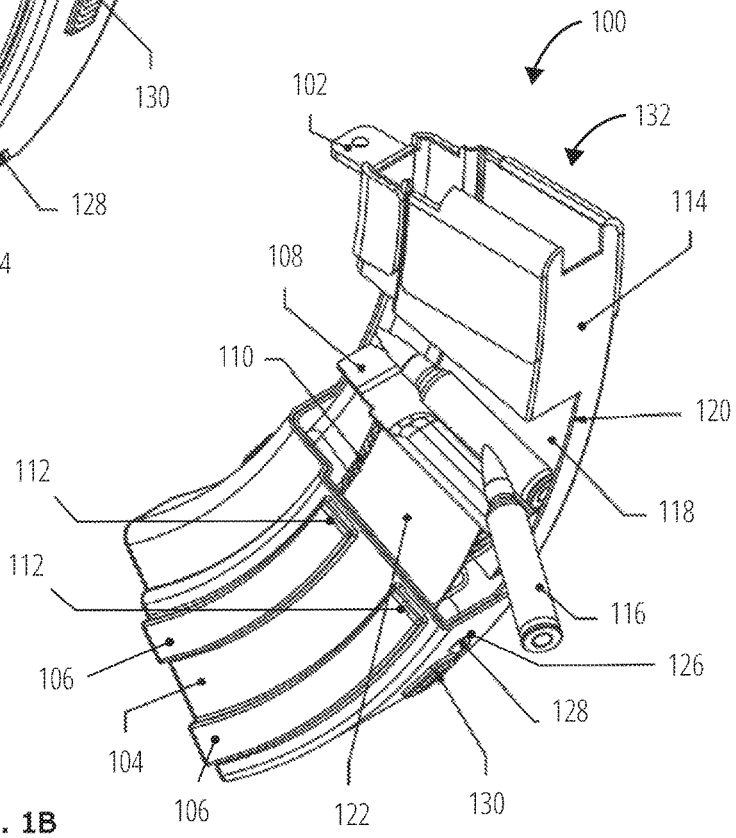
FIG. 1B is a perspective view of the magazine of FIG. 1A, showing the movable sleeve in the down position, revealing the side opening, showing one cartridge within the ammunition magazine, and also showing a cartridge being loaded into the ammunition magazine.

The movable sleeve 104 is shown in a closed position, covering the magazine cavity 118 (shown in FIG. 1B). Shown in this embodiment are two sleeve grooves 106 on each side of the ammunition magazine 100. The two sleeve grooves 106 on each side of the movable sleeve 104 receive and align with two respective pairs of follower tabs 204 of the cartridge follower 108 (shown in FIG. 2A) that extend outward from each carrier 122 (shown in FIG. 1B) of the cartridge follower 108. Each follower tab 204 (shown in FIG. 2A) slidably engages within and is aligned by a respective sleeve groove 106.

The ammunition magazine 100 also includes a locking button 128 springedly attached to the magazine body 114. The locking button 128 cooperates with a lower sleeve locking hole 124 configured to lock the movable sleeve 104 in an upward and closed position. Alternately, the locking button 128 can be disengaged from the lower sleeve locking hole 124 by depressing the locking button 128 using a finger of a user (not shown), and the finger of the user (not shown) can move the movable sleeve 104 to a lowered and open position. Moving the movable sleeve 104 to an open position or a closed position by the finger of a user (not shown) can be aided by a raised bump grip 130.

With reference to FIG. 1B, a perspective view is shown of the ammunition magazine 100 of FIG. 1A with the movable sleeve 104 in a down position along a magazine body 114, revealing a side opening 120 and a magazine cavity 118, facilitating the loading of a stack of cartridges 116.

As the movable sleeve 104 is lowered to a down and open position, four groove end catches 112 engage and pull down four follower tabs 204 (shown in FIG. 2A), also pulling down two carriers 122 of a cartridge follower 108, and compressing a cartridge follower spring 110.

The movable sleeve 104 is locked in a down position by engaging a locking button 128 with an upper sleeve locking hole 126. Moving the movable sleeve 104 to a down and open position by the finger of a user (not shown) can be aided by a raised bump grip 130.

In some embodiments, the magazine body 114, the movable sleeve 104, the cartridge follower 108, and the cartridge follower spring 110 are made from at least one of: metal, nylon, plastic, and carbon fiber.

Figure 2A:
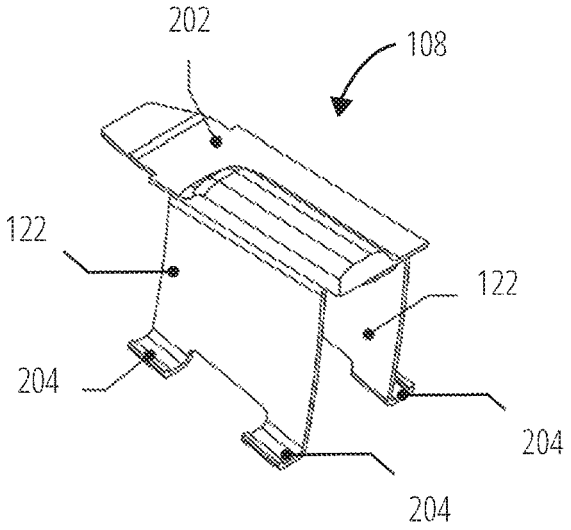
FIG. 2A is a perspective top view showing a cartridge follower having a cartridge follower top plate, at least one carrier, and at least one follower tab.

With reference to FIG. 2A, a perspective top view is shown of a cartridge follower 108 with a cartridge follower top plate 202 and two carriers 122 and four follower tabs 204. Each of the two carriers 122 is attached to the cartridge follower top plate 202, and each of the four follower tabs 204 is attached to the at least one carrier 122.

Figure 2B:
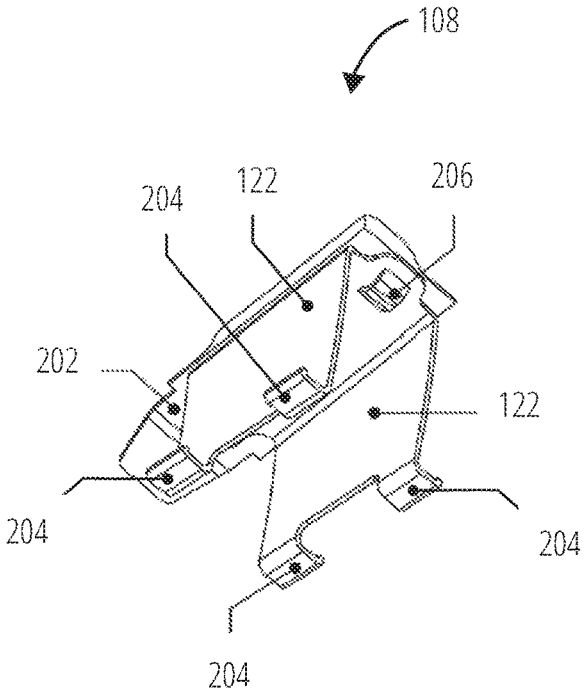
FIG. 2B is a perspective bottom view showing the cartridge follower of FIG. 2A having a cartridge follower top plate, at least one carrier, at least one follower tab, and at least one spring attachment tab.

With reference to FIG. 2B, a perspective bottom view is shown of a cartridge follower 108 with a cartridge follower top plate 202 and two carriers 122 and four follower tabs 204. Each carrier 122 is attached to the cartridge follower top plate 202, and each follower tab 204 is attached to the respective carrier 122. At least one spring attachment tab 206 is attached to the cartridge follower 108. The at least one spring attachment tab 206 is configured to attach the cartridge follower spring 110 (shown in FIG. 1B) to the cartridge follower 108.

Figure 3A:
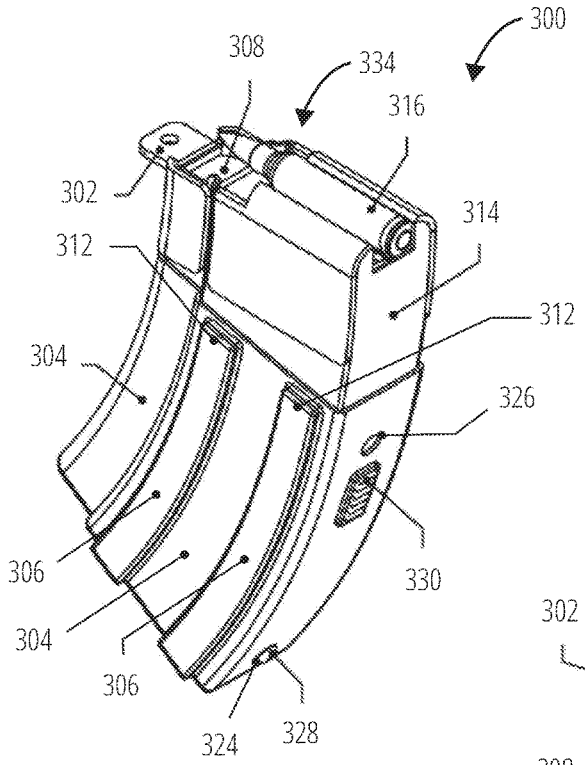
FIG. 3A is a perspective view showing the rear, side, and top views of an embodiment of an ammunition magazine that can be fixed to a firearm, while also facilitating loading of the ammunition magazine via a movable sleeve and a rear opening, with the movable sleeve in the upward position, also showing one cartridge within the ammunition magazine.

With reference to FIG. 3A, a perspective view is shown of an ammunition magazine 300 containing a cartridge 316. The ammunition magazine 300 includes an attachable blocking tab 302 which is to be fixedly attached to a firearm lower receiver (not shown) such that the ammunition magazine 300 is prevented from being easily removed from the firearm, i.e., from the bottom of the magazine well. The attachable blocking tab 302 blocks removal of the ammunition magazine 300 from the magazine well (not shown), the attachable blocking tab 302 being attached at a feeding end 334 after insertion of the ammunition magazine 300 into the magazine well (not shown), and before re-engaging the upper receiver (not shown) with the lower receiver (not shown).

Other embodiments of the ammunition magazine 300 may have alternative fixing methods to the attachable blocking tab 302, such as screws or other types of tabs, and all alternative fixing methods will attach the ammunition magazine 300 to the firearm lower receiver (not shown) in accordance with local laws.

In this embodiment, a movable sleeve 304 is configured to be pulled down along a magazine body 314. As the movable sleeve 304 is pulled down, four groove end catches 312 engage four respective follower tabs 404 of a cartridge follower 308 (shown in FIG. 4A), thereby pulling down the cartridge follower 308 (shown in FIG. 3B) and compressing a cartridge follower spring 310 (shown in FIG. 3B). This action opens a space within magazine body 314 so as to provide access through a side opening 320 (shown in FIG. 3B) to a magazine cavity 318 (shown in FIG. 3B) configured to receive the stack of cartridges 316.

Figure 3B:
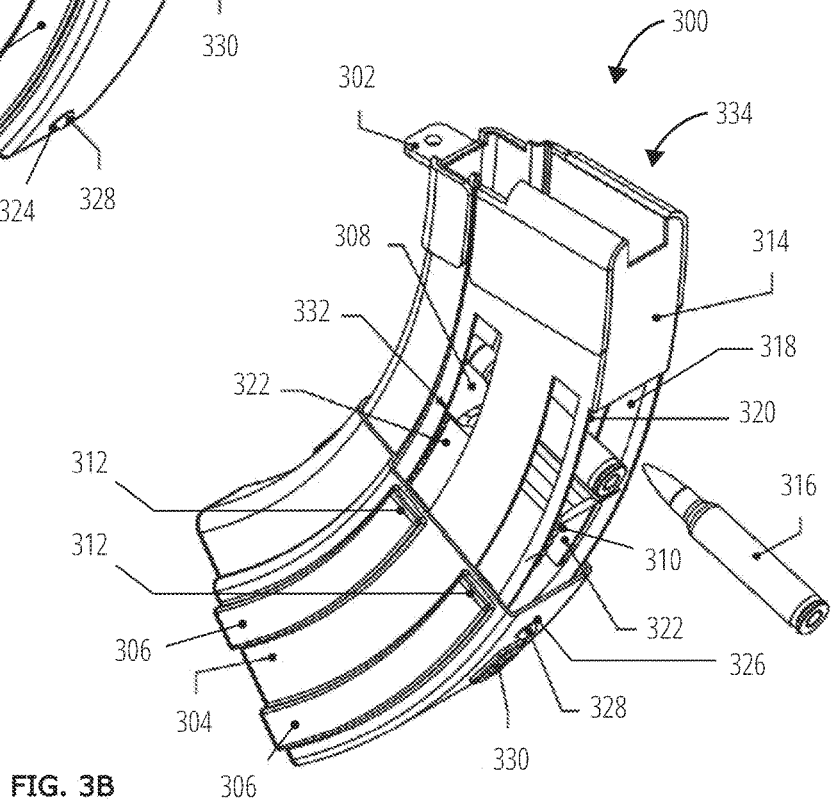
FIG. 3B is a perspective view of the magazine of FIG. 3A, showing the movable sleeve in the down position, revealing the rear opening, showing one cartridge within the ammunition magazine, and also showing a cartridge being loaded into the ammunition magazine.

The movable sleeve 304 is shown in a closed position, covering the magazine cavity 318 (shown in FIG. 3B). Shown in this embodiment are two sleeve grooves 306 on each side of the ammunition magazine 300. The two sleeve grooves 306 on each side of the movable sleeve 304 receive and align with two respective pairs of follower tabs 404 of the cartridge follower 308 (shown in FIG. 4A) that extend outward from each carrier 322 (shown in FIG. 3B) of the cartridge follower 308. Each follower tab 404 (shown in FIG. 4A) slidably engages within and is aligned by a respective sleeve groove 306.

The ammunition magazine 300 also includes a locking button 328 springedly attached to the magazine body 314. The locking button 328 cooperates with a lower sleeve locking hole 324 configured to lock the movable sleeve 304 in an upward and closed position. Alternately, the locking button 328 can be disengaged from the lower sleeve locking hole 324 by depressing the locking button 328 using a finger of a user (not shown), and the finger of the user (not shown) can move the movable sleeve 304 to a lowered and open position. Moving the movable sleeve 304 to an open position or a closed position by the finger of a user (not shown) can be aided by a raised bump grip 330.

With reference to FIG. 3B, a perspective view is shown of the ammunition magazine 300 of FIG. 3A with the movable sleeve 304 in a down position along a magazine body 314, revealing a side opening 320 and a magazine cavity 318, facilitating the loading of a stack of cartridges 316.

As the movable sleeve 304 is lowered to a down and open position, four groove end catches 312 engage and pull down four follower tabs 404 (shown in FIG. 4A), also pulling down two carriers 322 of a cartridge follower 308, and compressing a cartridge follower spring 310.

The movable sleeve 304 is locked in a down position by engaging a locking button 328 with an upper sleeve locking hole 326. Moving the movable sleeve 304 to a down and open position by the finger of a user (not shown) can be aided by a raised bump grip 330.

In some embodiments, the magazine body 314, the movable sleeve 304, the cartridge follower 308, and the cartridge follower spring 310 are made from at least one of: metal, nylon, plastic, and carbon fiber.

Figure 4A:
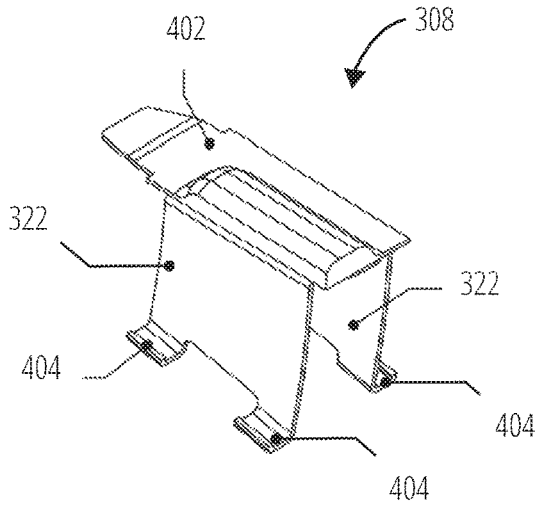
FIG. 4A is a perspective top view showing a cartridge follower having a cartridge follower top plate, at least one carrier, and at least one follower tab.

With reference to FIG. 4A, a perspective top view is shown of a cartridge follower 308 with a cartridge follower top plate 402 and two carriers 322 and four follower tabs 404. Each of the two carriers 322 is attached to the cartridge follower top plate 402, and each of the four follower tabs 404 is attached to the at least one carrier 322.

Figure 4B:
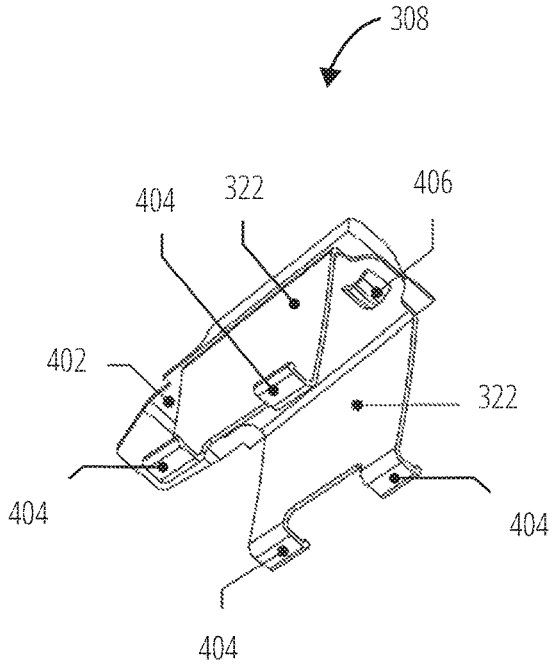
FIG. 4B is a perspective bottom view showing the cartridge follower of FIG. 4A having a cartridge follower top plate, at least one carrier, at least one follower tab, and at least one spring attachment tab.

With reference to FIG. 4B, a perspective bottom view is shown of a cartridge follower 308 with a cartridge follower top plate 402 and two carriers 322 and four follower tabs 404. Each carrier 322 is attached to the cartridge follower top plate 402, and each follower tab 404 is attached to the respective carrier 322. At least one spring attachment tab 406 is attached to the cartridge follower 308. The at least one spring attachment tab 406 is configured to attach the cartridge follower spring 310 (shown in FIG. 3B) to the cartridge follower 308.

Figures 5A, 5B:
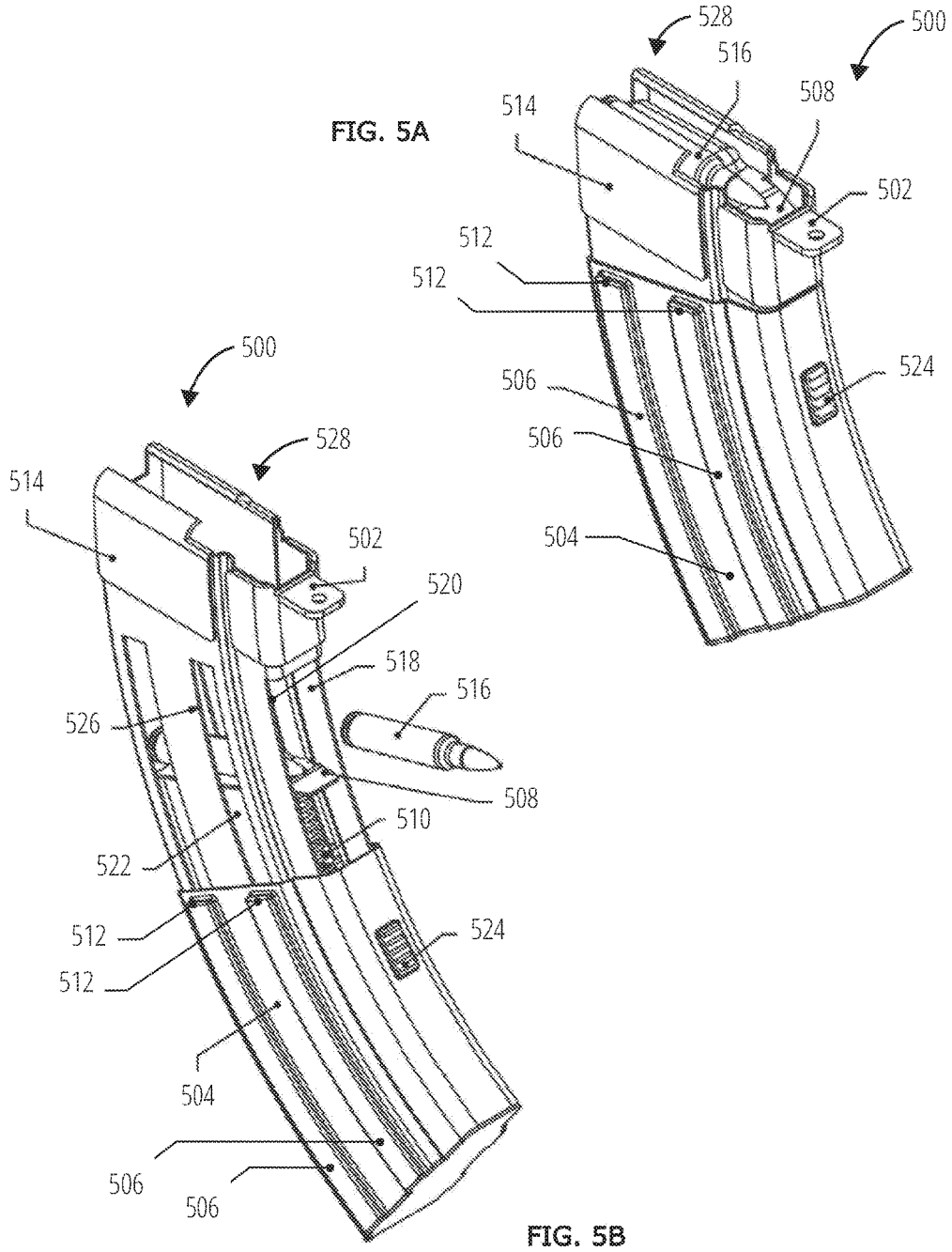
FIG. 5A is a perspective view showing the rear, side, and top views of an embodiment of an ammunition magazine that can be fixed to a firearm, while also facilitating loading of the ammunition magazine via a movable sleeve and a front opening, with the movable sleeve in the upward position, also showing one cartridge within the ammunition magazine.
FIG. 5B is a perspective view of the magazine of FIG. 5A, showing the movable sleeve in the down position, revealing the front opening, showing one cartridge within the ammunition magazine, and also showing a cartridge being loaded into the ammunition magazine.

With reference to FIG. 5A, a perspective view is shown of an ammunition magazine 500 containing a cartridge 516. The ammunition magazine 500 includes an attachable blocking tab 502 which is to be fixedly attached to a firearm lower receiver (not shown) such that the ammunition magazine 500 is prevented from being easily removed from the firearm, i.e., from the bottom of the magazine well. The attachable blocking tab 502 blocks removal of the ammunition magazine 500 from the magazine well (not shown), the attachable blocking tab 502 being attached at a feeding end 528 after insertion of the ammunition magazine 500 into the magazine well (not shown), and before re-engaging the upper receiver (not shown) with the lower receiver (not shown).

Other embodiments of the ammunition magazine 500 may have alternative fixing methods to the attachable blocking tab 502, such as screws or other types of tabs, and all alternative fixing methods will attach the ammunition magazine 500 to the firearm lower receiver (not shown) in accordance with local laws.

In this embodiment, a movable sleeve 504 is configured to be pulled down along a magazine body 514. As the movable sleeve 504 is pulled down, four groove end catches 512 engage four respective follower tabs 604 of a cartridge follower 508 (shown in FIG. 6A), thereby pulling down the cartridge follower 508 (shown in FIG. 5B) and compressing a cartridge follower spring 510 (shown in FIG. 5B). This action opens a space within magazine body 514 so as to provide access through a side opening 520 (shown in FIG. 5B) to a magazine cavity 518 (shown in FIG. 5B) configured to receive the stack of cartridges 516.

The movable sleeve 504 is shown in a closed position, covering the magazine cavity 518 (shown in FIG. 5B). Shown in this embodiment are two sleeve grooves 506 on each side of the ammunition magazine 500. The two sleeve grooves 506 on each side of the movable sleeve 504 receive and align with two respective pairs of follower tabs 604 of the cartridge follower 508 (shown in FIG. 6A) that extend outward from each carrier 522 (shown in FIG. 5B) of the cartridge follower 508. Each follower tab 604 (shown in FIG. 6A) slidably engages within and is aligned by a respective sleeve groove 506.

The ammunition magazine 500 also includes a locking button (not shown) springedly attached to the magazine body 514. The locking button (not shown) cooperates with a lower sleeve locking hole (not shown) configured to lock the movable sleeve 504 in an upward and closed position. Alternately, the locking button (not shown) can be disengaged from the lower sleeve locking hole (not shown) by depressing the locking button (not shown) using a finger of a user (not shown), and the finger of the user (not shown) can move the movable sleeve 504 to a lowered and open position. Moving the movable sleeve 504 to an open position or a closed position by the finger of a user (not shown) can be aided by a raised bump grip 524.

With reference to FIG. 5B, a perspective view is shown of the ammunition magazine 500 of FIG. 5A with the movable sleeve 504 in a down position along a magazine body 514, revealing a side opening 520 and a magazine cavity 518, facilitating the loading of a stack of cartridges 516.

As the movable sleeve 504 is lowered to a down and open position, four groove end catches 512 engage and pull down four follower tabs 604 (shown in FIG. 6A), also pulling down two carriers 522 of a cartridge follower 508, and compressing a cartridge follower spring 510.

The movable sleeve 504 is locked in a down position by engaging a locking button (not shown) with an upper sleeve locking hole (not shown). Moving the movable sleeve 504 to a down and open position by the finger of a user (not shown) can be aided by a raised bump grip 524.

In some embodiments, the magazine body 514, the movable sleeve 504, the cartridge follower 508, and the cartridge follower spring 510 are made from at least one of: metal, nylon, plastic, and carbon fiber.

Figure 6A:
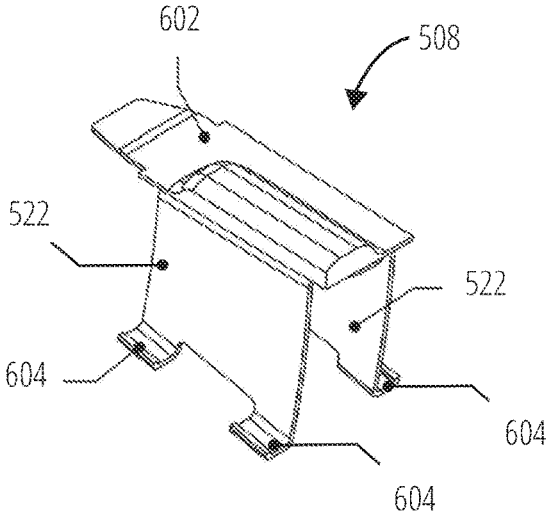
FIG. 6A is a perspective top view showing a cartridge follower having a cartridge follower top plate, at least one carrier, and at least one follower tab.

With reference to FIG. 6A, a perspective top view is shown of a cartridge follower 508 with a cartridge follower top plate 602 and two carriers 522 and four follower tabs 604. Each of the two carriers 522 is attached to the cartridge follower top plate 602, and each of the four follower tabs 604 is attached to the at least one carrier 522.

Figure 6B:
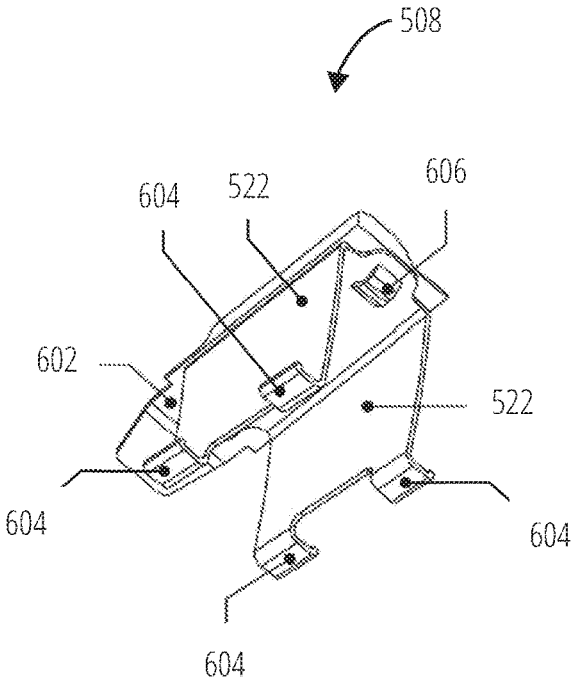
FIG. 6B is a perspective bottom view showing the cartridge follower of FIG. 6A having a cartridge follower top plate, at least one carrier, at least one follower tab, and at least one spring attachment tab.

With reference to FIG. 6B, a perspective bottom view is shown of a cartridge follower 508 with a cartridge follower top plate 602 and two carriers 522 and four follower tabs 604. Each carrier 522 is attached to the cartridge follower top plate 602, and each follower tab 604 is attached to the respective carrier 522. At least one spring attachment tab 606 is attached to the cartridge follower 508. The at least one spring attachment tab 606 is configured to attach the cartridge follower spring 510 (shown in FIG. 5B) to the cartridge follower 508.

Installing the Fixed Magazine

To install the affixable magazine of the invention (e.g., any of the embodiments disclosed herein) on the firearm, the upper receiver is first separated from the lower receiver. Once the top of the lower receiver is exposed, the affixable magazine of the invention is inserted up into the magazine well.

In some embodiments of the invention, a blocking tab is then placed over the top of the affixable magazine such that the blocking tab overlaps a portion of the upper side of the lower receiver. The blocking tab is then attached to the affixable magazine using a screw which fixes the tab to both the lower receiver and the affixable magazine, so that the fixed magazine cannot be removed from the firearm without separating the upper receiver and the lower receiver.

Loading the Magazine

Because the magazine is fixed to the firearm while the upper receiver and the lower receiver of the firearm are engaged, the magazine cannot be loaded from the top of the fixed magazine. Instead, a side-loading method is used. A sliding sleeve located on the magazine is opened to allow the magazine to be loaded with cartridges. In addition, when loading the magazine, a downward movement of the sliding sleeve retracts the spring-loaded cartridge follower. When the sliding sleeve is in the down position, the magazine spring is compressed, the cartridge follower is in a down position, and the magazine body is opened. The open magazine body provides space for loading the stack of ammunition cartridges. Once this magazine body is opened, the user can easily load ammunition cartridges into the magazine body.

Once the stack of cartridges is loaded, the sliding sleeve is closed by sliding it upwards, and the cartridge follower pushes up against the stack of cartridges, allowing the magazine and the firearm to work normally.

Other modifications and implementations will occur to those skilled in the art without departing from the spirit and the scope of the invention as claimed. Accordingly, the above description is not intended to limit the invention, except as indicated in the following claims.

What is claimed is:

1. An affixable ammunition magazine configured for use with a firearm with an upper receiver and a lower receiver, the receivers configured to be disengaged and re-engaged, the lower receiver having a magazine well for receiving the ammunition magazine, the ammunition magazine comprising:

a magazine body configured to contain a stack of cartridges, the magazine body having a feeding end configured to feed rounds of ammunition to the firearm, the magazine body including a side opening;

a movable sleeve configured to surround the magazine body and secure the stack of cartridges, the movable sleeve having at least one sleeve groove along at least one side, the at least one sleeve groove having a groove end catch;

a cartridge follower assembly having:

a cartridge follower, and a cartridge follower spring configured to be compressed by the cartridge follower when the groove end catch has engaged with and has pulled down the cartridge follower, and the cartridge follower spring is configured to expand when the groove end catch is disengaged from the cartridge follower, thereby allowing the cartridge follower to urge the stack of cartridges towards the feeding end of the magazine body; and an attachable blocking tab configured to be attached to the feeding end of the magazine body, and configured to block removal of the ammunition magazine from the magazine well, the attachable blocking tab being attached to the feeding end of the magazine body after insertion of the ammunition magazine into the magazine well, and before re-engaging the upper receiver with the lower receiver.

2. The affixable ammunition magazine of claim 1, wherein the cartridge follower includes:

a cartridge follower top plate configured to push upward on the bottom of the stack of cartridges, at least one carrier, and at least one follower tab configured to slidably engage within the at least one sleeve groove, the at least one follower tab configured to engage with and be pulled downward by the groove end catch when the movable sleeve is in a down position.

3. The affixable ammunition magazine of claim 1, further comprising:

a locking button springedly attached to the magazine body, configured to cooperate with an upper sleeve locking hole to secure the movable sleeve in an open position, and the locking button alternately configured to cooperate with a lower sleeve locking hole to secure the movable sleeve in a closed position.

4. The affixable ammunition magazine of claim 1, wherein the cartridge follower includes at least one spring attachment tab configured to attach to the cartridge follower spring.

5. The affixable ammunition magazine of claim 1, wherein the movable sleeve includes a raised bump grip.

6. The affixable ammunition magazine of claim 1, wherein the magazine body, the movable sleeve, the cartridge follower, and the cartridge follower spring are made from at least one of: metal, nylon, plastic, carbon fiber.

7. An affixable ammunition magazine configured for use with a firearm with an upper receiver and a lower receiver, the receivers configured to be disengaged and re-engaged, the lower receiver having a magazine well for receiving the ammunition magazine, the ammunition magazine comprising:

a magazine body configured to contain a stack of cartridges, the magazine body having a feeding end configured to feed rounds of ammunition to the firearm, the magazine body including a rear opening;

a movable sleeve configured to surround the magazine body and secure the stack of cartridges, the movable sleeve having at least one sleeve groove along at least one side, the at least one sleeve groove having a groove end catch;

a cartridge follower assembly having:

a cartridge follower, and a cartridge follower spring configured to be compressed by the cartridge follower when the groove end catch has engaged with and has pulled down the cartridge follower, and the cartridge follower spring is configured to expand when the groove end catch is disengaged from the cartridge follower, thereby allowing the cartridge follower to urge the stack of cartridges towards the feeding end of the magazine body; and an attachable blocking tab configured to be attached to the feeding end of the magazine body, and configured to block removal of the ammunition magazine from the magazine well, the attachable blocking tab being attached to the feeding end of the magazine body after insertion of the ammunition magazine into the magazine well, and before re-engaging the upper receiver with the lower receiver.

8. The affixable ammunition magazine of claim 7, wherein the cartridge follower includes:

a cartridge follower top plate configured to push upward on the bottom of the stack of cartridges, an at least one carrier, and at least one follower tab configured to slidably engage within the at least one sleeve groove, the at least one follower tab configured to engage with and be pulled downward by the groove end catch when the movable sleeve is in a down position.

9. The affixable ammunition magazine of claim 7, further comprising:

a locking button springedly attached to the magazine body, configured to cooperate with an upper sleeve locking hole to secure the movable sleeve in an open position, and the locking button alternately configured to cooperate with a lower sleeve locking hole to secure the movable sleeve in a closed position.

10. The affixable ammunition magazine of claim 7, wherein the cartridge follower includes at least one spring attachment tab configured to attach to the cartridge follower spring.

11. The affixable ammunition magazine of claim 7, wherein the movable sleeve includes a raised bump grip.

12. The affixable ammunition magazine of claim 7, wherein the magazine body, the movable sleeve, the cartridge follower, and the cartridge follower spring are made from at least one of: metal, nylon, plastic, carbon fiber.

13. An affixable ammunition magazine configured for use with a firearm with an upper receiver and a lower receiver, the receivers configured to be disengaged and re-engaged, the lower receiver having a magazine well for receiving the ammunition magazine, the ammunition magazine comprising:

a magazine body configured to contain a stack of cartridges, the magazine body having a feeding end configured to feed rounds of ammunition to the firearm, the magazine body including a front opening;

a movable sleeve configured to surround the magazine body and secure the stack of cartridges, the movable sleeve having at least one sleeve groove along at least one side, the at least one sleeve groove having a groove end catch;

a cartridge follower assembly having:

a cartridge follower, and a cartridge follower spring configured to be compressed by the cartridge follower when the groove end catch has engaged with and has pulled down the cartridge follower, and the cartridge follower spring is configured to expand when the groove end catch is disengaged from the cartridge follower, thereby allowing the cartridge follower to urge the stack of cartridges towards the feeding end of the magazine body; and an attachable blocking tab configured to be attached to the feeding end of the magazine body, and configured to block removal of the ammunition magazine from the magazine well, the attachable blocking tab being attached to the feeding end of the magazine body after insertion of the ammunition magazine into the magazine well, and before re-engaging the upper receiver with the lower receiver.

14. The affixable ammunition magazine of claim 13, wherein the cartridge follower includes:

a cartridge follower top plate configured to push upward on the bottom of the stack of cartridges, an at least one carrier, and at least one follower tab configured to slidably engage within the at least one sleeve groove, the at least one follower tab configured to engage with and be pulled downward by the groove end catch when the movable sleeve is in a down position.

15. The affixable ammunition magazine of claim 13, further comprising:

a locking button springedly attached to the magazine body, configured to cooperate with an upper sleeve locking hole to secure the movable sleeve in an open position, and the locking button alternately configured to cooperate with a lower sleeve locking hole to secure the movable sleeve in a closed position.

16. The affixable ammunition magazine of claim 13, wherein the cartridge follower includes at least one spring attachment tab configured to attach to the cartridge follower spring.

17. The affixable ammunition magazine of claim 13, wherein the movable sleeve includes a raised bump grip.

18. The affixable ammunition magazine of claim 13, wherein the magazine body, the movable sleeve, the cartridge follower, and the cartridge follower spring are made from at least one of: metal, nylon, plastic, carbon fiber.

* * * * *